US010982466B2

(12) United States Patent
Huang

(10) Patent No.: US 10,982,466 B2
(45) Date of Patent: Apr. 20, 2021

(54) CANOPY FRAME WITH AN AUXILIARY OPENING MECHANISM

(71) Applicant: Xiamen Roadzup Outdoor Products Co., Ltd., Xiamen (CN)

(72) Inventor: Changjiu Huang, Xiamen (CN)

(73) Assignee: Xiamen Roadzup Outdoor Products Co., Ltd., Xiamen (CN)

( * ) Notice: Subject to any disclaimer, the term of this patent is extended or adjusted under 35 U.S.C. 154(b) by 0 days.

(21) Appl. No.: 16/742,853

(22) Filed: Jan. 14, 2020

(65) Prior Publication Data

US 2020/0407999 A1 Dec. 31, 2020

(30) Foreign Application Priority Data

Jun. 28, 2019 (CN) ..... 201910577182.1

(51) Int. Cl.
*E04H 15/50* (2006.01)

(52) U.S. Cl.
CPC ..... *E04H 15/50* (2013.01)

(58) Field of Classification Search
CPC ..... E04H 15/50; E04H 15/28
USPC ..... 135/135
See application file for complete search history.

(56) References Cited

U.S. PATENT DOCUMENTS 4,256,129 A * 3/1981 Gilsenan ..... E04H 15/50 135/143
6,854,476 B1 2/2005 Chai
9,181,724 B2 * 11/2015 Kim ..... E04H 15/32
9,739,073 B2 * 8/2017 Huang ..... E04H 15/322
9,995,057 B2 * 6/2018 Wu ..... E04H 15/405
9,995,058 B2 * 6/2018 Jin ..... G08C 17/02
10,060,153 B2 8/2018 Song
10,119,297 B2 * 11/2018 Choi ..... E04H 15/46
10,246,898 B2 * 4/2019 Jin ..... E04H 15/46
10,273,711 B2 * 4/2019 Song ..... E04H 15/48
10,280,645 B1 * 5/2019 Yang ..... E04H 15/18
10,597,897 B2 * 3/2020 Yang ..... E04H 15/46
10,669,738 B2 * 6/2020 Yang ..... E04H 15/48
2006/0016467 A1 1/2006 Bae
2007/0017561 A1 1/2007 Kuo
2011/0023924 A1 2/2011 Park
(Continued)

FOREIGN PATENT DOCUMENTS

CN 203129699 U 8/2013
CN 107859427 A 3/2018
(Continued)

*Primary Examiner* — Noah Chandler Hawk
(74) *Attorney, Agent, or Firm* — Cooper Legal Group, LLC

(57) ABSTRACT

The present disclosure discloses a canopy frame with an auxiliary opening mechanism, which includes a top connecting base, a plurality of frame rod sets, a middle connecting base, a bottom connecting base, an elastic member, and a first positioning mechanism. Each of the plurality of frame rod sets includes a standing column, a canopy rod set, a first support rod, and a second support rod. The canopy rod set includes a first canopy rod. The auxiliary opening mechanism includes the middle connecting base, the bottom connecting base, the elastic member, the first positioning mechanism, the first support rod, and the second support rod. The canopy can be unfolded more effortlessly, and even a single person can complete an unfolding operation of the canopy.

18 Claims, 11 Drawing Sheets

(56) References Cited

U.S. PATENT DOCUMENTS

| | | | | |
|---|---|---|---|---|
| 2015/0308147 | A1* | 10/2015 | Lee | E04H 1/1205<br>135/145 |
| 2018/0298631 | A1* | 10/2018 | Yang | E04H 15/46 |
| 2019/0234101 | A1* | 8/2019 | Lu | E04H 15/18 |

FOREIGN PATENT DOCUMENTS

| | | | | |
|---|---|---|---|---|
| CN | 207245328 | U | 4/2018 | |
| CN | 207714893 | U | 8/2018 | |
| CN | 109667467 | A | 4/2019 | |
| CN | 110725608 | A | 1/2020 | |
| EP | 0005061 | A2 * | 10/1979 | E04H 15/50 |
| GB | 2495530 | A | 4/2013 | |
| WO | 2004072414 | A1 | 8/2004 | |
| WO | WO-2004072414 | A1 * | 8/2004 | E04H 15/48 |

* cited by examiner

CANOPY FRAME WITH AN AUXILIARY OPENING MECHANISM

RELATED APPLICATIONS

This application claims priority to Chinese Patent Application 201910577182.1, filed on Jun. 28, 2019. Chinese Patent Application 201910577182.1 is incorporated herein by reference.

FIELD OF THE DISCLOSURE

The present disclosure relates to camping gear, and in particular relates to a canopy frame with an auxiliary opening mechanism.

BACKGROUND OF THE DISCLOSURE

Protecting structures of camping gear are generally divided into tents and canopies. One of the differences between tents and canopies is an upper and lower positional relationship between a tarpaulin and a rod frame. Tents comprise a tent frame (e.g., the rod frame) and the tarpaulin disposed under the tent frame. Canopies comprise a canopy frame (e.g., the rod frame) and the tarpaulin disposed on the canopy frame.

Existing canopy frames comprises a top connecting base and a plurality of frame rod sets. Each of the plurality of frame rod sets comprises a standing column, a canopy rod set and a support rod. A top of the standing column comprises a mounting base, and the standing column comprises a sliding base. The canopy rod set comprises a first canopy rod and a second canopy rod. An inner end of the first canopy rod is rotatably connected to the top connecting base, and an inner end of the second canopy rod is rotatably connected to an outer end of the first canopy rod. An outer end of the second canopy rod is rotatably connected to the mounting base. A lower end of the support rod is rotatably connected to the sliding base, and an upper end of the support rod is rotatably connected to the second canopy rod. A scissor mechanism is further disposed between the mounting base, the sliding base of a first standing column and the mounting base and the sliding base of a second standing column, which is adjacent to the first standing column. The scissor mechanism comprises at least one scissor unit. In order to keep the canopy frame in an unfolded state, it is necessary to provide a locking mechanism between the standing column and the sliding base. Therefore, existing canopy frames have the following deficiencies. First, when being folded, it is necessary to release the locking mechanism between the standing column and the sliding base, resulting in the operation step being complex and an unfolding process or a folding process being inconvenient. Second, when being unfolded, it is necessary to push the sliding base relative to the standing column. In order to ensure that the plurality of standing columns push up relative to the sliding base synchronously, multiple people may be required to work together, and confirming whether the locking mechanism is in a locked state is complex. Therefore, the unfolding process or the folding process is inconvenient.

In response to the above deficiencies, some people have proposed solutions.

For example, in Chinese patent CN207714893U, a plurality of bottom connecting bases is added in the original canopy frame, and a rotatable rod is rotatably connected between a bottom connecting base and a first canopy rod. A first end of the rotatable rod is rotatably connected to the bottom connecting base, and a second end is rotatably connected to the first canopy rod. A foldable rod set is disposed between the top connecting base and the bottom connecting base, and a tension spring is disposed between the bottom connecting base and the top connecting base. The canopy frame is assisted to be unfolded by the tension of the tension spring, and a distance between the bottom connecting base and the top connecting base is limited by a shortest length position of the foldable rod assembly. The distance is therefore limited by the foldable rod assembly. The rotatable rod and the first canopy rod define a triangular structure, which is configured to keep the canopy frame in an unfolded position.

In U.S. Ser. No. 10/060,153B2 or Chinese patent CN109667467A, a plurality of bottom connecting bases is added, and a rotatable rod is rotatably connected between a bottom connecting base and the first canopy rod. A first end of the rotatable rod is rotatably connected to the bottom connecting base, and a second end of the rotatable rod is rotatably connected to the first canopy rod. A positioning rod is fixedly disposed under the top connecting base. When being unfolded, the bottom connecting base passes through a dead point, and the bottom connecting base abuts the positioning rod. A distance between the bottom connecting base and the top connecting base are limited. Therefore, the distance is limited to make the rotatable rod and the first canopy rod define a triangular structure, which is configured to keep the canopy frame in an unfolded position.

The above-mentioned canopy frame is maintained in an unfolded state by locking a distance between the top connecting base and the bottom connecting base, which results in a complicated structure and a high cost structure.

BRIEF SUMMARY OF THE DISCLOSURE

The present disclosure provides a canopy frame with an auxiliary opening mechanism to solve deficiencies of the canopy frames of the existing techniques.

In order to solve the aforementioned technical problems, a technical solution of the present disclosure is as follows.

A canopy frame with an auxiliary opening mechanism comprises a top connecting base, a plurality of frame rod sets, a middle connecting base, a bottom connecting base, an elastic member, and a first positioning mechanism. Each of the plurality of frame rod sets comprises a standing column, a canopy rod set, a first support rod, and a second support rod. A top end of the standing column comprises a mounting base. A first end of the canopy rod set comprises a first canopy rod that is rotatably connected to the top connecting base, and a second end of the canopy rod set is rotatably connected to the mounting base. Two ends of the first support rod are respectively rotatably connected to the middle connecting base and the first canopy rod, and two ends of the second support rod are respectively rotatably connected to the bottom connecting base and the first support rod. The middle connecting base and the bottom connecting base are disposed in a vertical direction and are configured to be moved away from each other and brought toward each other. The elastic member is disposed between the middle connecting base and the bottom connecting base to generate an elastic force to move the middle connecting base away from the bottom connecting base. The first positioning mechanism is configured to limit a maximum distance between the middle connecting base and the bottom connecting base. The auxiliary opening mechanism comprises the middle connecting base, the bottom connecting base, the elastic member, the first positioning mechanism, the first support rod, and the second support rod.

In another preferred embodiment, the canopy frame with an auxiliary opening mechanism comprises a sliding base. The sliding base is slidably connected to the standing column, and the canopy rod set comprises a second canopy rod. An inner end of the second canopy rod is rotatably connected to an outer end of the first canopy rod, and an outer end of the second canopy rod is rotatably connected to the mounting base. Each of the plurality of frame rod sets comprises a third support rod. Two ends of the third support rod are respectively rotatably connected to the second canopy rod and the sliding base. The standing column or the sliding base is disposed with a second positioning mechanism configured to restrict a highest position of the sliding base.

In another preferred embodiment, the second positioning mechanism comprises a second positioning member disposed on the standing column. The second positioning member is disposed under the mounting base and protrudes from at least one side of the standing column, and the sliding base abuts the second positioning member when the canopy frame is in an unfolded state.

In another preferred embodiment, the second positioning mechanism comprises a height increasing portion disposed on the sliding base, and the height increasing portion abuts the mounting base when the canopy frame is in an unfolded state.

In another preferred embodiment, the second positioning mechanism comprises a height increasing portion disposed on the sliding base and a second positioning member disposed on the standing column. The second positioning member is disposed under the mounting base and protrudes from a side of the standing column, and the height increasing portion abuts the second positioning member when the canopy frame is in an unfolded state.

In another preferred embodiment, the height increasing portion comprises a surrounding portion surrounding on the standing column.

In another preferred embodiment, the canopy frame with an auxiliary opening mechanism comprises a sliding base. The sliding base is slidably connected to the standing column, and the canopy rod set comprises a second canopy rod. An inner end of the second canopy rod is rotatably connected to an outer end of the first canopy rod, and an outer end of the second canopy rod is rotatably connected to the mounting base. Each of the plurality of frame rod sets comprises a third support rod. Two ends of the third support rod are respectively rotatably connected to the second canopy rod and the sliding base. A third positioning mechanism is disposed between the first canopy rod and the second canopy rod to limit a maximum arching angle of the first canopy rod and the second canopy rod.

In another preferred embodiment, the third positioning mechanism comprises a rotatable joint, and the outer end of the first canopy rod and the inner end of the second canopy rod are connected by the rotatable joint.

In another preferred embodiment, the auxiliary opening mechanism comprises a guide rod. The bottom connecting base is fixedly connected to the guide rod, and the middle connecting base is slidably connected to the guide rod. The elastic member comprises a spring surrounding an outside of the guide rod, and the spring is disposed between and abuts the bottom connecting base and the middle connecting base.

In another preferred embodiment, an upper portion of the guide rod comprises a first positioning member. At least a portion of the first positioning member protrudes from a side of the guide rod. The middle connecting base slidably surrounds an outside of the guide rod and is disposed between the first positioning member and the bottom connecting base. The middle connecting base abuts the first positioning member when the canopy frame is in an unfolded state.

In another preferred embodiment, the canopy frame is configured to be switched between an unfolded state and a folded state, and an angle between the first support rod and the middle connecting base passes through a dead point when the canopy frame is switched between the unfolded state and the folded state.

In another preferred embodiment, a distance between a rotation axis of the first support rod and the first canopy rod, and an outer end of the first canopy rod is shorter than a length of the first support rod.

Compared with existing techniques, the technical solution of the present disclosure has the following advantages.

The auxiliary opening mechanism comprises the middle connecting base, the bottom connecting base, the elastic member, the first positioning mechanism, the first support rod, and the second support rod. Therefore, the canopy frame is disposed with three connecting bases. The top connecting base, the middle connecting base, the bottom connecting base, the elastic member, the first support rod, the second support rod, and the first positioning mechanism are disposed to serve as a locking mechanism between the sliding base and the standing column. Locking of the canopy frame is secure and reliable. Moreover, the canopy frame can be unfolded or folded effortlessly. Even a single person can complete an unfolding process of the canopy frame, which perfectly solves the deficiencies of the existing canopy frames that are difficult to unfold. The canopy frame is a linked structure, and the elastic force of the elastic member makes the canopy frame more stable after being fully unfolded. The structure is simple and production is convenient.

BRIEF DESCRIPTION OF THE DRAWING

The present disclosure will be further described below with the combination of the accompanying drawings together with the embodiments.

DETAILED DESCRIPTION OF THE EMBODIMENTS

Embodiment 1

Referring to FIGS. 1-13, a canopy frame with an auxiliary opening mechanism comprises a top connecting base 1 and a plurality of frame rod sets 2.

Figure 1:
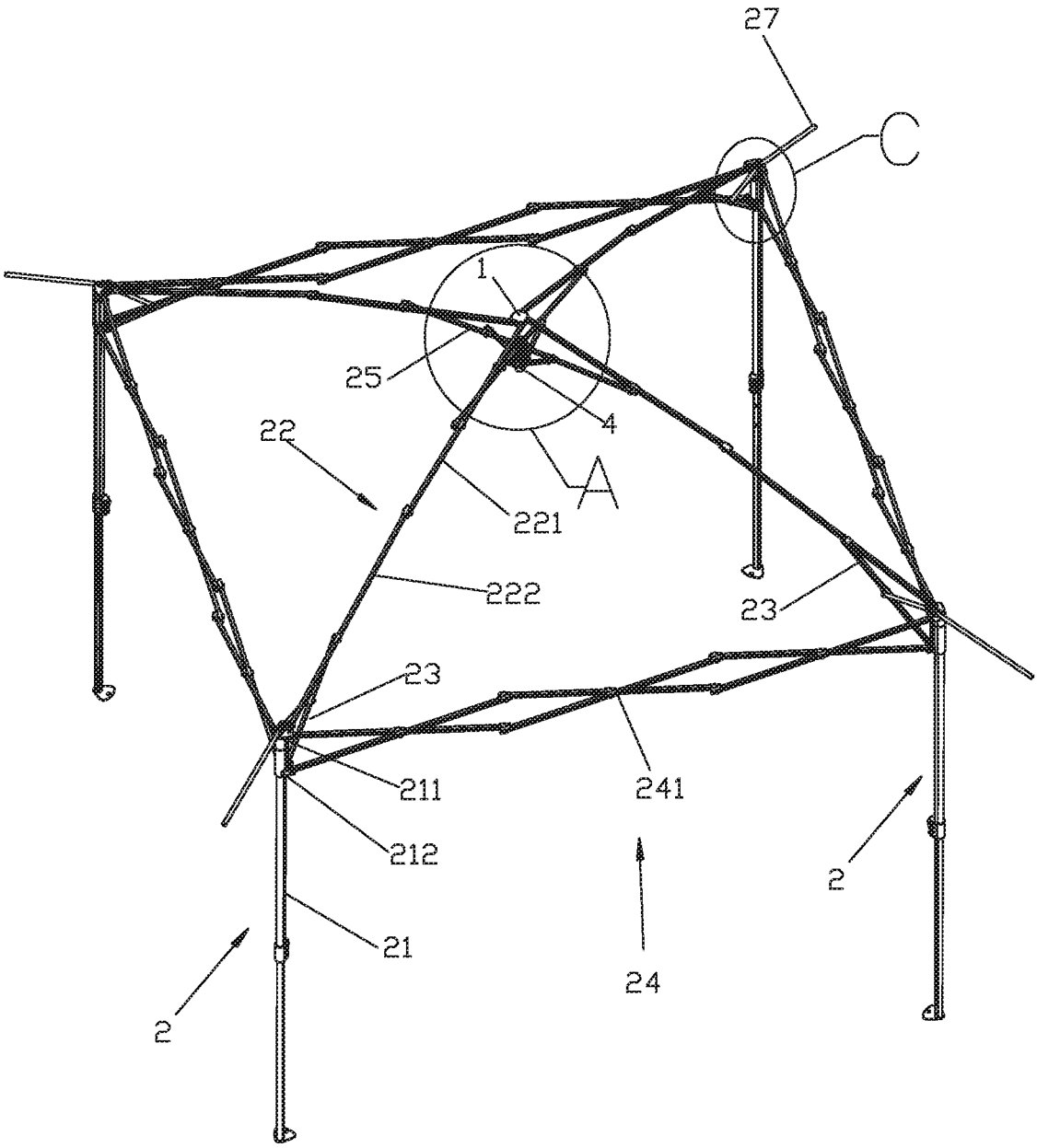
FIG. 1 illustrates a perspective view of a canopy frame of Embodiment 1 in an unfold state, and a plurality of standing columns are in an unfolded state.
Figure 2:
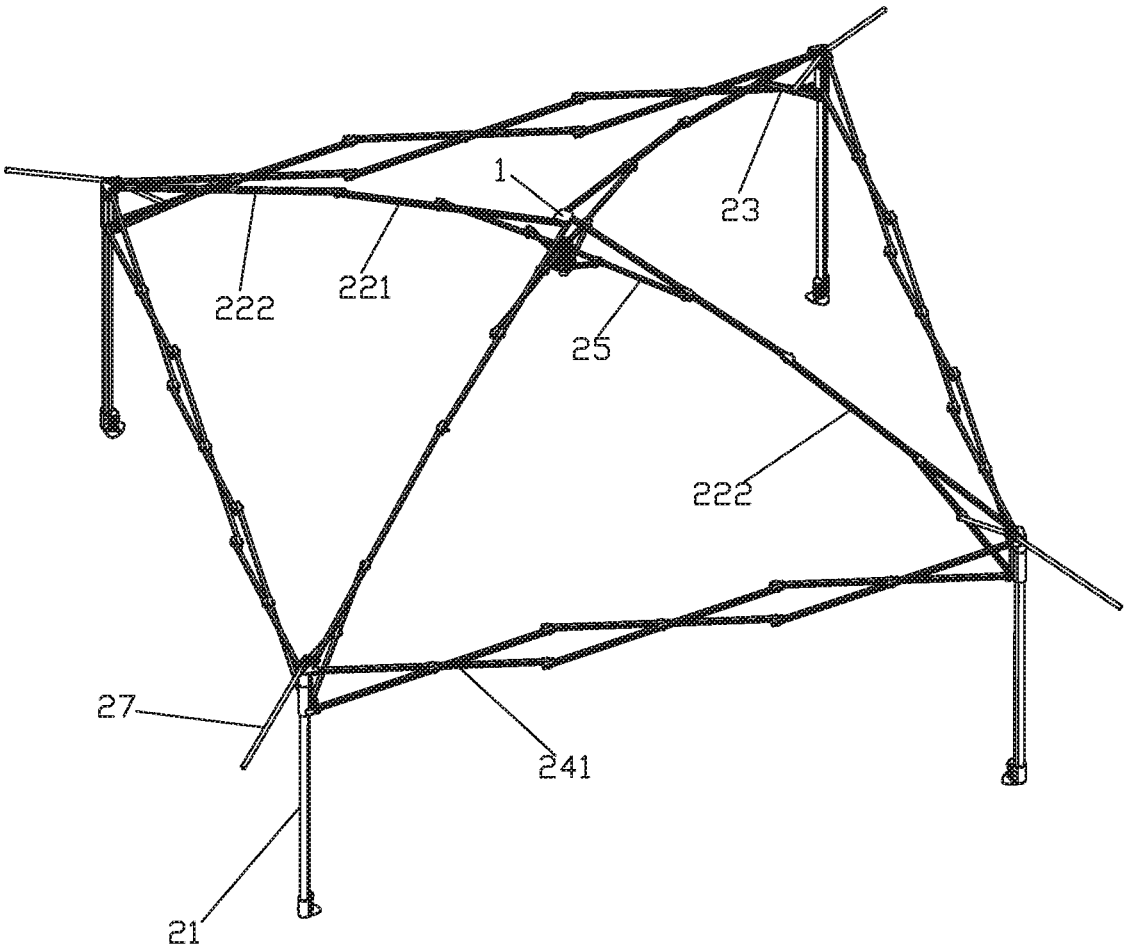
FIG. 2 illustrates a perspective view of the canopy frame of Embodiment 1 in an unfold state, and the plurality of standing columns are in a folded state.
Figure 3:
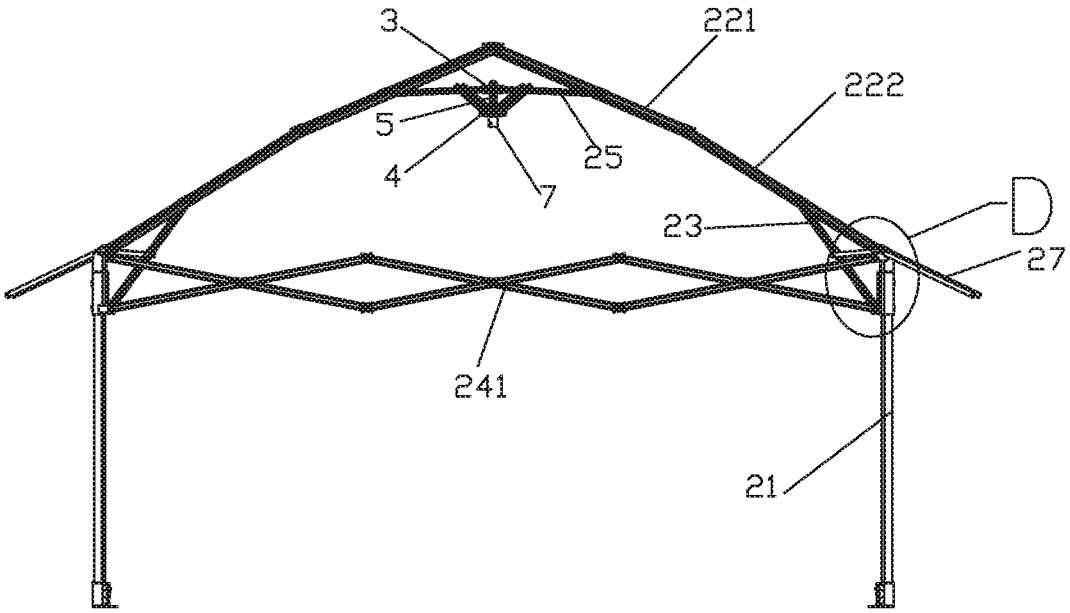
FIG. 3 illustrates a front schematic view of the canopy frame of Embodiment 1 in the unfolded state.
Figure 4:
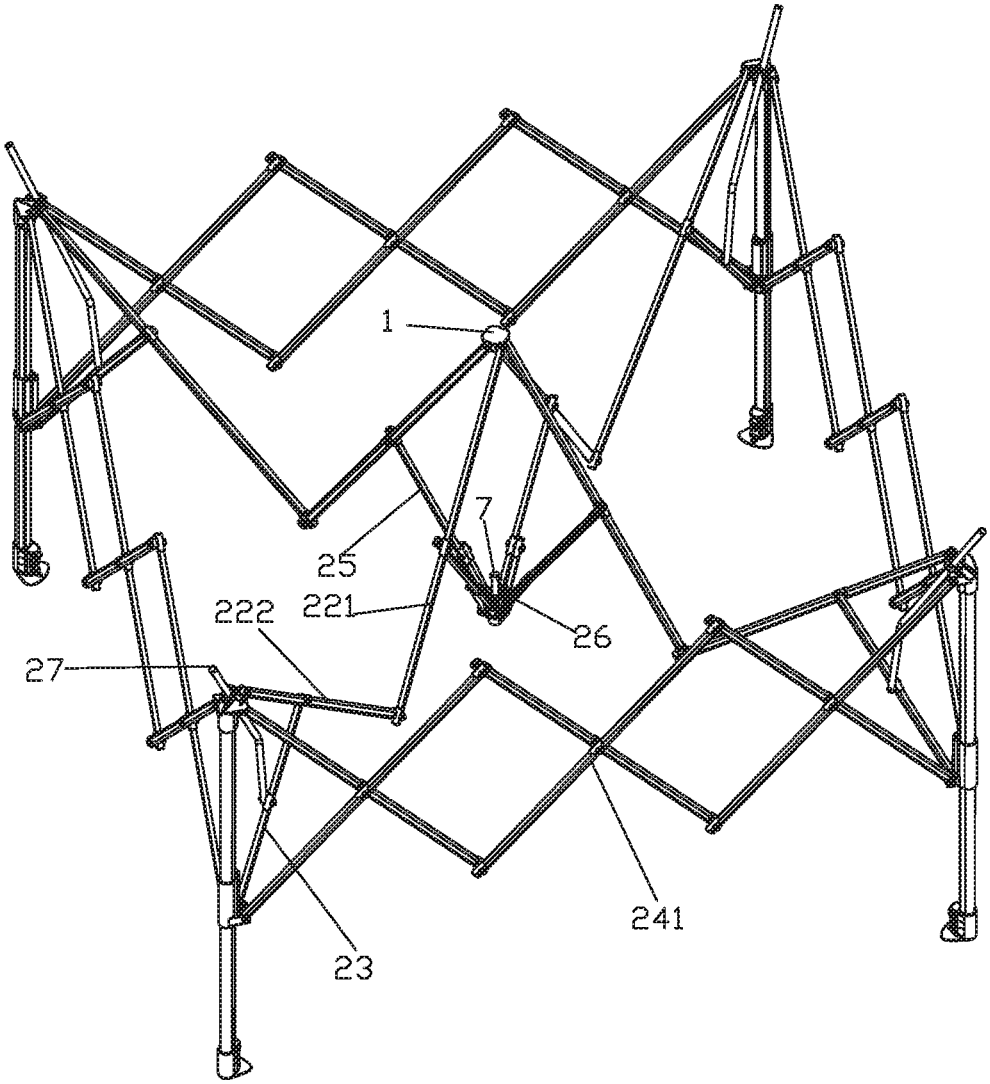
FIG. 4 illustrates a perspective view of the canopy frame of Embodiment 1 in a half-folded state.

Each of the plurality of frame rod sets 2 comprises a standing column 21, a canopy rod set 22, and a third support rod 23. The standing column 21 is a foldable rod (as shown in FIG. 1 and FIG. 2). A top end of the standing column 21 is disposed with a mounting base 211. A sliding base 212 is slidably connected to the standing column 21 and is configured to slide relative to the standing column 21 in a vertical direction. The canopy rod set 22 comprises a first canopy rod 221 and a second canopy rod 222. An inner end of the first canopy rod 221 is rotatably connected to the top connecting base 1, an inner end of the second canopy rod 222 is rotatably connected to an outer end of the first canopy rod 221, and an outer end of the second canopy rod 222 is rotatably connected to the mounting base 211. A lower end of the third support rod 23 is rotatably connected to the sliding base 212, and an upper end is rotatably connected to the second canopy rod 222.

A scissor mechanism 24 is rotatably disposed between the mounting base 211 of a first one of a plurality of standing columns 21 and the mounting base 211 of a second one of the plurality of standing columns 21, which is adjacent to the first one of the plurality of standing columns 21, and is rotatably disposed between the sliding base 212 of the first one of a plurality of standing columns 21 and the sliding base 212 of the second one of the plurality of standing columns 21. The scissor mechanism 24 comprises a plurality of scissor units 241 connected in series.

The canopy frame further comprises a middle connecting base 3, a bottom connecting base 4, an elastic member 5, a first positioning mechanism 6, and a guide rod 7. The bottom connecting base 4 is disposed on a bottom of the guide rod 7, and the middle connecting base 3 is disposed under the top connecting base 1. The middle connecting base 3 is configured to be slidably disposed on the guide rod 7 in the vertical direction and is disposed above the bottom connecting base 4. The middle connecting base 3 and the bottom connecting base 4 are disposed in the vertical direction and are configured to be moved away from each other and brought toward each other. The elastic member 5 comprises a spring. The spring surrounds the guide rod 7, is disposed between the bottom connecting base 4 and the middle connecting base 3, and abuts the bottom connecting base 4 and the middle connecting base 3 to generate an elastic force to move the middle connecting base 3 away from the bottom connecting base 4 and a push force for pushing the middle connecting base 3 to slide upward. The first positioning mechanism 6 limits a maximum distance between the middle connecting base 3 and the bottom connecting base 4. In a specific embodiment, the first positioning member 71 is disposed on an upper portion of the guide rod 7, at least a portion of the first positioning member 71 protrudes from a side of the guide rod 7, the middle connecting base 3 is slidably disposed on an outside of the guide rod 7 and disposed between the first positioning member 71 and the bottom connecting base 4, and the middle connecting base 3 abuts the first positioning member 71 when the canopy frame is in an unfolded state. Further, the first positioning member 71 is a positioning pin fixedly passing through the guide rod 7, and the positioning pin has an extending portion protruding from the side of the guide rod 7. The extending portion is connected to the middle connecting base 3 when the canopy frame is in an unfolded state. Each of the plurality of frame rod sets 2 further comprises a first support rod 25 and a second support rod 26. The first support rod 25 is longer than the second support rod 26. Two ends of the first support rod 25 are respectively rotatably connected to the middle connecting base 3 and the first canopy rod 221, and two ends of the second support rod 26 are respectively rotatably connected to the bottom connecting base 4 and the first support rod 25. The auxiliary opening mechanism comprises the middle connecting base 3, the bottom connecting base 4, the elastic member 5, the first positioning mechanism 6, the guide rod 7, the first support rod 25, and the second support rod 26.

The canopy frame comprises a second positioning mechanism 201 configured to restrict a highest position of the sliding base 212 to which it is possible for the sliding base 212 to slide. When the sliding base 212 is at the highest position, the canopy frame is in the unfolded state, the middle connecting base 3 abuts the first positioning mechanism 6, and the middle connecting base 3 and the bottom connecting base 4 are separated from each other by a maximum distance. In the embodiment, the second positioning mechanism 201 comprises a height increasing portion 213 disposed on the sliding base 212, and the height increasing portion 213 abuts the mounting base 211 when the canopy frame is in the unfolded state. In a specific structure, the height increasing portion 213 comprises a surrounding portion 2131 surrounding the standing column 21, and the height increasing portion 213 and the sliding base 212 may be integrally molded. The above-mentioned height increasing portion 213 is configured to be used in combination with the mounting base 211 to achieve positioning, supporting strength is increased, and hand operation is facilitated.

Figure 6:
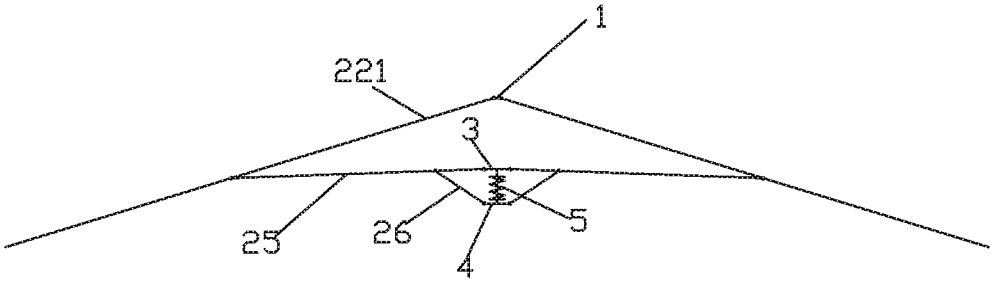
FIG. 6 illustrates a schematic view of a working principle of the canopy frame of Embodiment 1.
Figure 7:
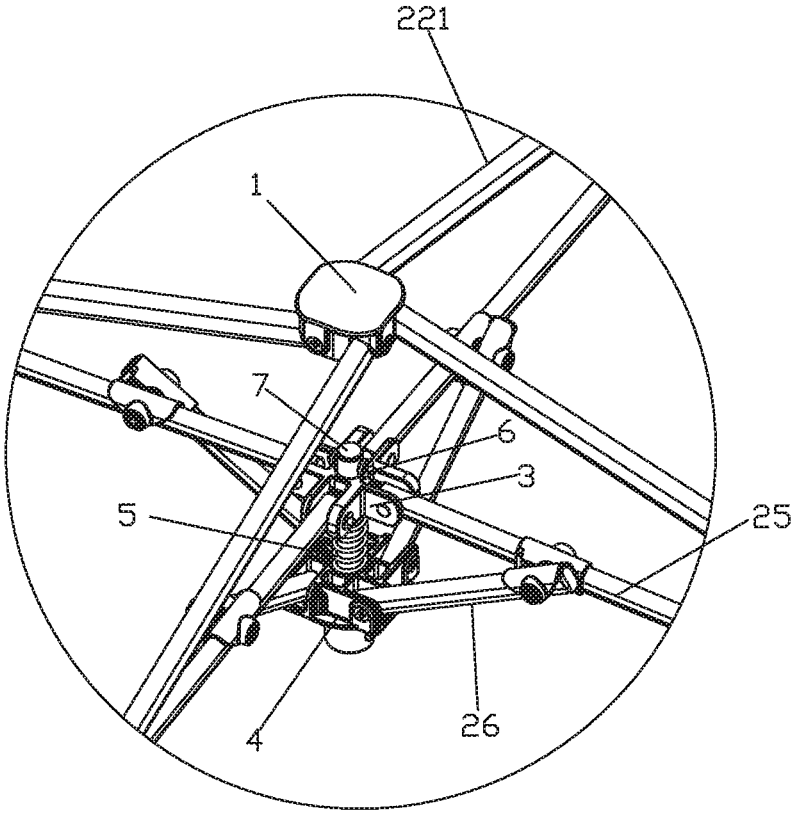
FIG. 7 illustrates an enlarged schematic view of a portion A of FIG. 1.
Figure 8:
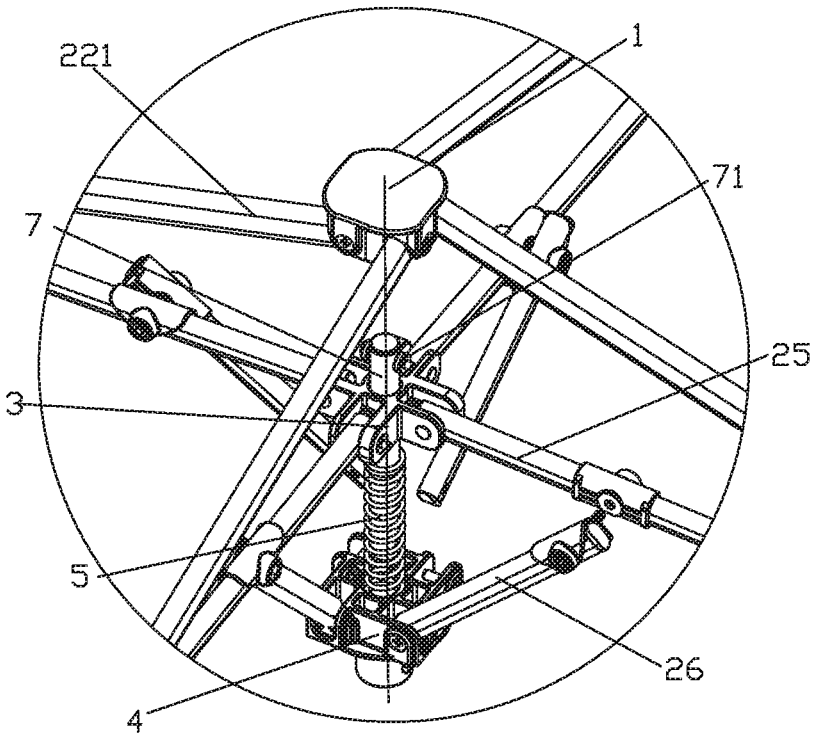
FIG. 8 illustrates an exploded perspective view of the portion A of FIG. 1.
Figure 9:
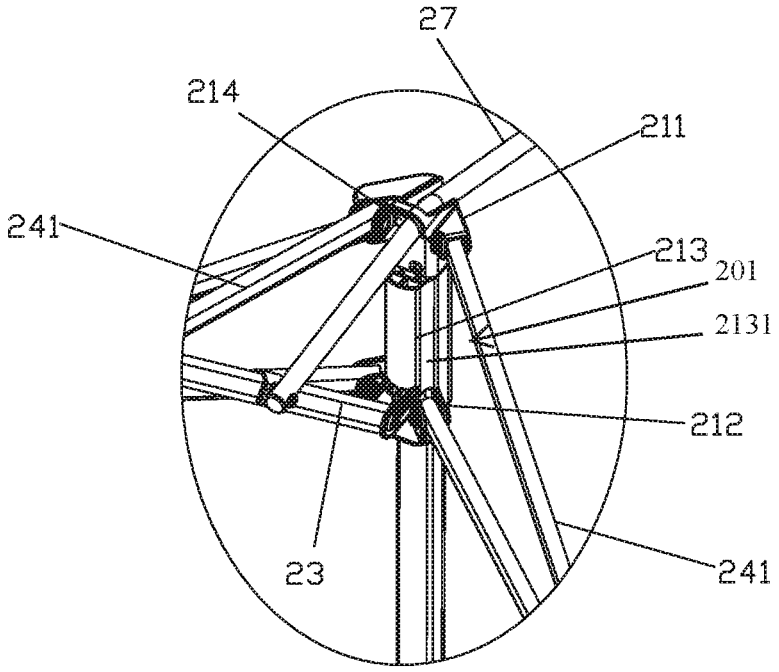
FIG. 9 illustrates an enlarged schematic view of a portion C of FIG. 1.
Figure 10:
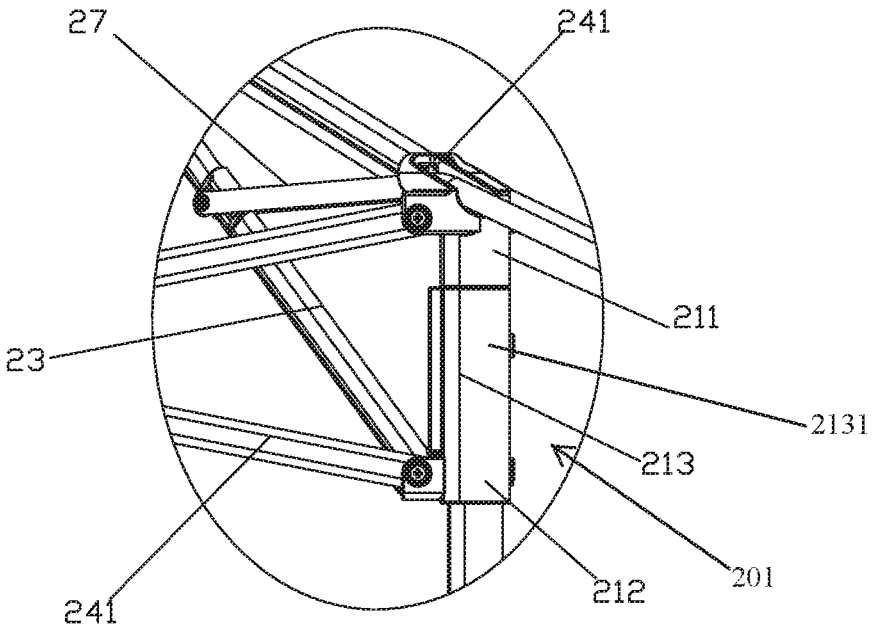
FIG. 10 illustrates an enlarged schematic view of a portion D of FIG. 3.
Figure 11:
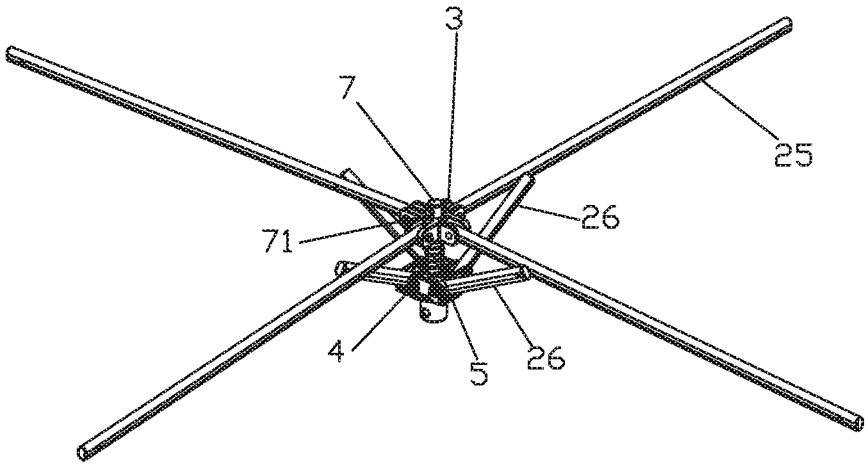
FIG. 11 illustrates a perspective view of an auxiliary opening mechanism of Embodiment 1 in the unfolded state.
Figure 12:
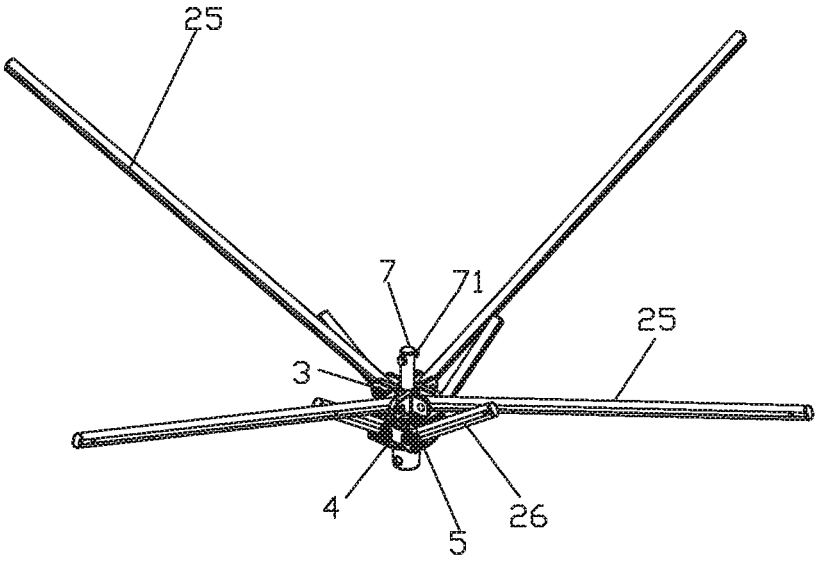
FIG. 12 illustrates a perspective view of the auxiliary opening mechanism of Embodiment 1 in the half-folded state.

In this embodiment, the canopy frame is configured to be switched between the unfolded state and a folded state, and an angle between the first support rod 25 and the middle connecting base 3 passes through a dead point when the canopy frame is switched between the unfolded state and the folded state. The dead point is a 180 degree angle formed between the first support rod 25 and the middle connecting base 3. By this setting, a supporting strength of the canopy frame in the unfolded state can be increased, as shown in FIG. 6. During an unfolding process of the canopy frame, an angle formed between the first support rod 25 and the middle connecting base 3 is changed from less than 180 degree to 181-190 degrees (e.g., 182 degrees), or for example, from less than 90 degree or equal to 90 degree or slightly more than 90 degree to 182 degree.

Figure 5:
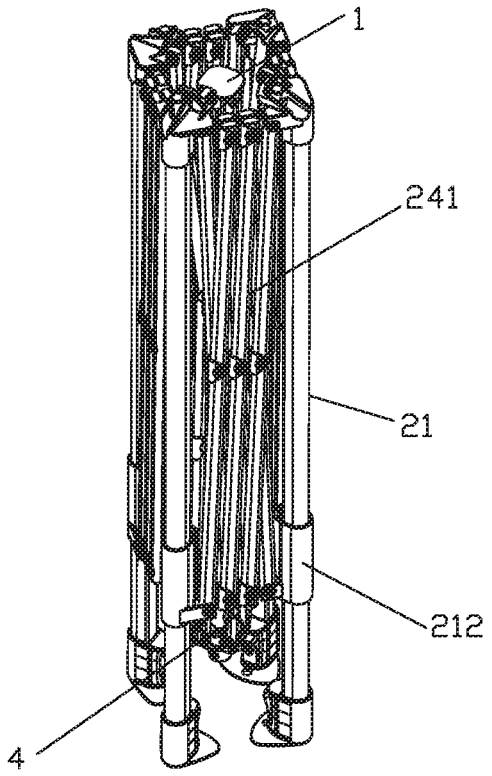
FIG. 5 illustrates a perspective view of the canopy frame of Embodiment 1 in a fully folded state.
Figure 13:
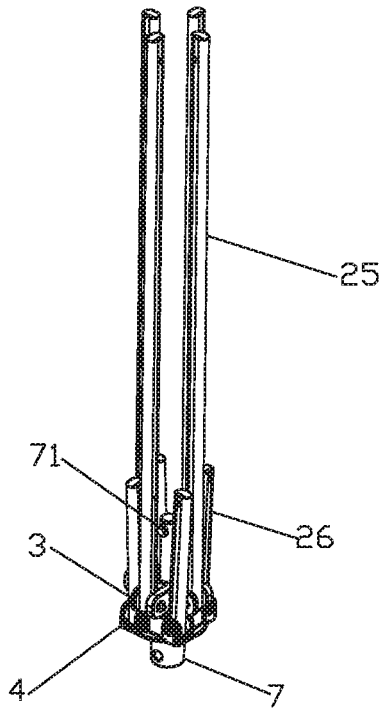
FIG. 13 illustrates a perspective view of the auxiliary opening mechanism of Embodiment 1 in the fully folded state.

In this embodiment, a distance from a rotation axis of the first support rod 25 and the first canopy rod 221 to an outer end of the first canopy rod 221 is shorter than a length of the first support rod 25. During a folding process, the middle connecting base 3 and the bottom connecting base 4 are located below the first canopy rod 221 (as shown in FIGS. 5 and 13) to prevent the middle connecting base 3, the bottom connecting base 4 and the like from causing interference during the folding of the canopy rod set 22.

A working principle of the canopy frame of this embodiment is as follows. An elastic force of the elastic member 5 (e.g., spring) abuts the middle connecting base 3 and the bottom connecting base 4 to move or push the middle connecting base 3 and the bottom connecting base 4 away from each other, so that the first support rod 25 has a tendency to open. The first support rod 25 drives the first canopy rod 221 to open, so that the process of unfolding the canopy frame saves labor of the user. The elastic force of the elastic member 5 has an ancillary effect on unfolding the canopy frame. That is, a part of a force configured to unfold or fold the canopy frame is applied by the elastic force. Further, when the canopy frame is half-open and the user enters into the canopy frame, it is easier to unfold the canopy frame by pushing the bottom connecting base 4 upward. When the canopy frame is completely unfolded, the elastic member 5 (e.g., spring) is still in a certain compression state. Under the elastic force of the elastic member 5, there is always a certain force to prevent the canopy frame from being folded. Thereby, the canopy frame is effectively stabilized. That is, the canopy frame can be kept in the unfolded state by the elastic force of the elastic member 5 even in case a locking mechanism is omitted in the canopy frame. When folding the canopy frame, a user pulls down the bottom connecting base 4 with a certain force to fold the canopy frame.

Each of the plurality of frame rod sets 2 further comprises an eaves rod 27. An inner end of the eaves rod 27 is rotatably connected to the third support rod 23, and an outer end of the eaves rod 27 passes through a through passage 215 defined in the mounting base 211. When the canopy frame is unfolded, the eaves rod 27 is configured to be driven to extend out of the through passage 215 to form an eave. When the canopy frame is folded, the eaves rod 27 can be contracted, and an occupied space after folding is small.

Embodiment 2

Figure 14:
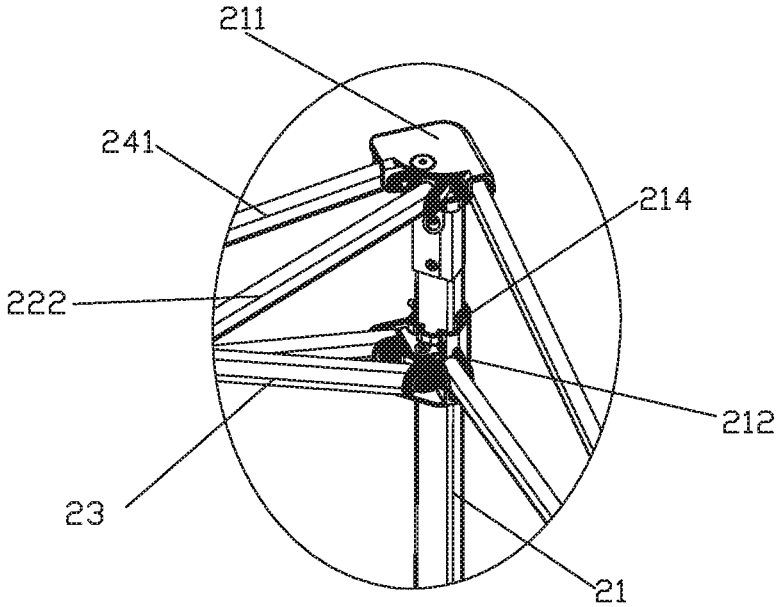
FIG. 14 illustrates a schematic view of a portion of a canopy frame of Embodiment 2.

Referring to FIG. 14, Embodiment 2 differs from Embodiment 1 in that the second positioning mechanism 201 comprises a second positioning member 214 disposed on the standing column 21, the second positioning member 214 is disposed below the mounting base 211, and protrudes from two sides of the standing column 21. The sliding base 212 abuts the second positioning member 214 to achieve positioning, the second positioning member 214 is a positioning pin fixedly disposed on the standing column 21, and the positioning pin has an extending portion protruding from a surface of the standing column 21, the sliding base 212 cooperates with the extending portion to achieve positioning.

Embodiment 3

Figure 15:
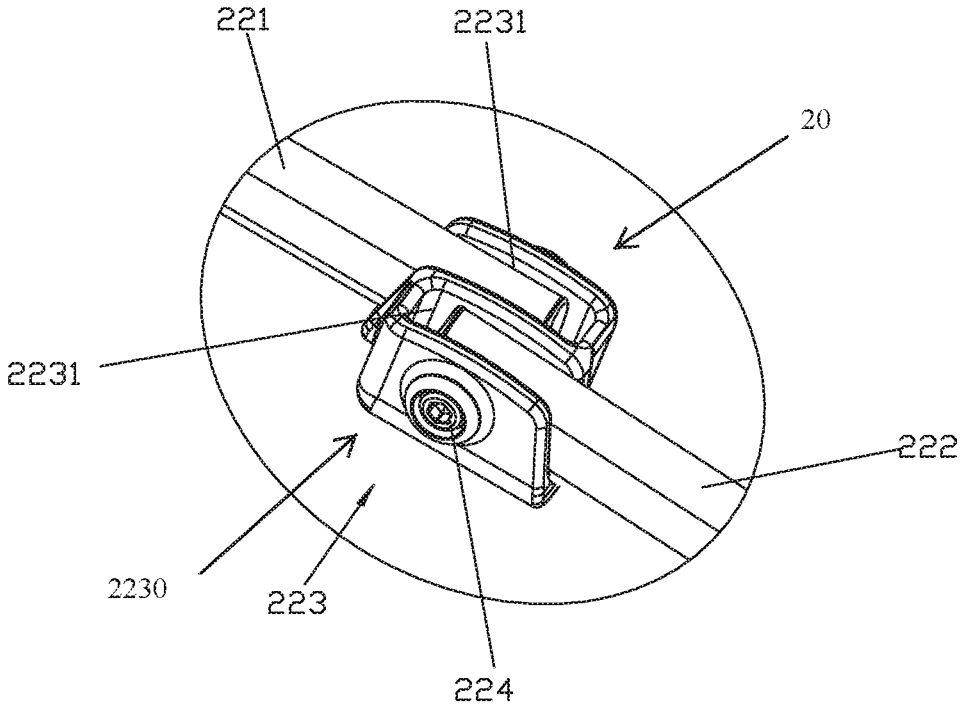
FIG. 15 illustrates a schematic view of a portion of a canopy frame of Embodiment 3.

Referring to FIG. 15, Embodiment 3 differs from Embodiment 1 in that a third positioning mechanism 20 is disposed between the first canopy rod 221 and the second canopy rod 222 to limit a maximum arching angle of the first canopy rod 221 and the second canopy rod 222. When the first canopy rod 221 and the second canopy rod 222 are in the maximum arching angle, the canopy frame is in the unfolded state, the middle connecting base 3 abuts the first positioning mechanism 6, and the middle connecting base 3 and the bottom connecting base 4 are separated from each other by a maximum distance. The third positioning mechanism 20 comprises a rotatable joint 223. The first canopy rod 221 and the second canopy rod 222 are connected by the rotatable joint 223. In a specific structure, the rotatable joint 223 comprises a base body 2230, and two connecting grooves 2231 are disposed inwardly from a top surface of the base body. The two connecting grooves 2231 are arranged in parallel, and a right end of a first connecting groove of the two connecting grooves 2231 is connected to a right side wall of the base body, and a left end of a second connecting groove of the two connecting grooves 2231 is connected to a left side wall of the base body. The first canopy rod 221 and the second canopy rod 222 are respectively disposed in the two connecting grooves 2231, and a rotatable shaft 224 is disposed to pass through the first canopy rod 221, the second canopy rod 222, and the base body to rotatably connect the first canopy rod 221 and the second canopy rod 222 to the rotatable joint 223.

The canopy frame comprises at least one selected from the second positioning mechanism 201 or the third positioning mechanism as needed.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A canopy frame with an auxiliary opening mechanism, comprising:

a top connecting base, a plurality of frame rod sets, a middle connecting base, a bottom connecting base, an elastic member, and a first positioning mechanism, wherein:

each of the plurality of frame rod sets comprises:

a standing column, a canopy rod set, a first support rod, and a second support rod, a top end of the standing column comprises a mounting base, a first end of the canopy rod set comprises a first canopy rod that is rotatably connected to the top connecting base, a second end of the canopy rod set is rotatably connected to the mounting base, two ends of the first support rod are respectively rotatably connected to the middle connecting base and the first canopy rod, two ends of the second support rod are respectively rotatably connected to the bottom connecting base and the first support rod, the middle connecting base and the bottom connecting base are disposed in a vertical direction and are configured to be moved away from each other and brought toward each other, the elastic member is disposed between the middle connecting base and the bottom connecting base to generate an elastic force to move the middle connecting base away from the bottom connecting base, the first positioning mechanism is configured to limit a maximum distance between the middle connecting base and the bottom connecting base, the auxiliary opening mechanism comprises the middle connecting base, the bottom connecting base, the elastic member, the first positioning mechanism, the first support rod, the second support rod, and a guide rod, the bottom connecting base is fixedly connected to the guide rod, the middle connecting base is slidably connected to the guide rod, the elastic member comprises a spring surrounding an outside of the guide rod, and the spring is disposed between and abuts the bottom connecting base and the middle connecting base.

2. The canopy frame with the auxiliary opening mechanism according to claim 1, comprising:

a sliding base, wherein:

the sliding base is slidably connected to the standing column, the canopy rod set comprises a second canopy rod, an inner end of the second canopy rod is rotatably connected to an outer end of the first canopy rod, an outer end of the second canopy rod is rotatably connected to the mounting base, each of the plurality of frame rod sets comprises a third support rod, two ends of the third support rod are respectively rotatably connected to the second canopy rod and the sliding base, and the standing column or the sliding base is disposed with a second positioning mechanism configured to restrict a highest position of the sliding base.

3. The canopy frame with the auxiliary opening mechanism according to claim 2, wherein:

the second positioning mechanism comprises a second positioning member disposed on the standing column, the second positioning member is disposed under the mounting base and protrudes from at least one side of the standing column, and the sliding base abuts the second positioning member when the canopy frame is in an unfolded state.

4. The canopy frame with the auxiliary opening mechanism according to claim 2, wherein:

the second positioning mechanism comprises a height increasing portion disposed on the sliding base, and the height increasing portion abuts the mounting base when the canopy frame is in an unfolded state.

5. The canopy frame with the auxiliary opening mechanism according to claim 4, wherein the height increasing portion comprises a surrounding portion surrounding the standing column.

6. The canopy frame with the auxiliary opening mechanism according to claim 2, wherein:

the second positioning mechanism comprises:

a height increasing portion disposed on the sliding base, and a second positioning member disposed on the standing column, the second positioning member is disposed under the mounting base and protrudes from a side of the standing column, and the height increasing portion abuts the second positioning member when the canopy frame is in an unfolded state.

7. The canopy frame with the auxiliary opening mechanism according to claim 6, wherein the height increasing portion comprises a surrounding portion surrounding the standing column.

8. The canopy frame with the auxiliary opening mechanism according to claim 1, comprising:

a sliding base, wherein:

the sliding base is slidably connected to the standing column, the canopy rod set comprises a second canopy rod, an inner end of the second canopy rod is rotatably connected to an outer end of the first canopy rod, an outer end of the second canopy rod is rotatably connected to the mounting base, each of the plurality of frame rod sets comprises a third support rod, two ends of the third support rod are respectively rotatably connected to the second canopy rod and the sliding base, and a third positioning mechanism is disposed between the first canopy rod and the second canopy rod to limit a maximum arching angle of the first canopy rod and the second canopy rod.

9. The canopy frame with the auxiliary opening mechanism according to claim 8, wherein:

the third positioning mechanism comprises a rotatable joint, and the outer end of the first canopy rod and the inner end of the second canopy rod are connected by the rotatable joint.

10. The canopy frame with the auxiliary opening mechanism according to claim 1, wherein:

an upper portion of the guide rod comprises a first positioning member, at least a portion of the first positioning member protrudes from a side of the guide rod, the middle connecting base slidably surrounds an outside of the guide rod and is disposed between the first positioning member and the bottom connecting base, and the middle connecting base abuts the first positioning member when the canopy frame is in an unfolded state.

11. The canopy frame with the auxiliary opening mechanism according to claim 1, wherein:

the canopy frame is configured to be switched between an unfolded state and a folded state, and an angle between the first support rod and the middle connecting base passes through a dead point when the canopy frame is switched between the unfolded state and the folded state.

12. The canopy frame with the auxiliary opening mechanism according to claim 1, wherein a distance from a rotation axis of the first support rod and the first canopy rod to an outer end of the first canopy rod is shorter than a length of the first support rod.

13. The canopy frame with the auxiliary opening mechanism according to claim 1, comprising:

a sliding base, wherein:

the sliding base is slidably connected to the standing column, the canopy rod set comprises a second canopy rod, an inner end of the second canopy rod is rotatably connected to an outer end of the first canopy rod, an outer end of the second canopy rod is rotatably connected to the mounting base, each of the plurality of frame rod sets comprises a third support rod, and two ends of the third support rod are respectively rotatably connected to the second canopy rod and the sliding base.

14. The canopy frame with the auxiliary opening mechanism according to claim 1, wherein a length of the first support rod is longer than a length of the second support rod.

15. A canopy frame with an auxiliary opening mechanism, comprising:

a top connecting base,
a plurality of frame rod sets,
a middle connecting base,
a bottom connecting base,
an elastic member,
a first positioning mechanism, and
a sliding base, wherein:
each of the plurality of frame rod sets comprises:
a standing column,
a canopy rod set,
a first support rod,
a second support rod, and
a third support rod,
a top end of the standing column comprises a mounting base,
a first end of the canopy rod set comprises a first canopy rod that is rotatably connected to the top connecting base,
a second end of the canopy rod set is rotatably connected to the mounting base,
two ends of the first support rod are respectively rotatably connected to the middle connecting base and the first canopy rod,
two ends of the second support rod are respectively rotatably connected to the bottom connecting base and the first support rod,
the sliding base is slidably connected to the standing column,
the canopy rod set comprises a second canopy rod,
an inner end of the second canopy rod is rotatably connected to an outer end of the first canopy rod,
an outer end of the second canopy rod is rotatably connected to the mounting base,
two ends of the third support rod are respectively rotatably connected to the second canopy rod and the sliding base,
the standing column or the sliding base is disposed with a second positioning mechanism configured to restrict a highest position of the sliding base,
the middle connecting base and the bottom connecting base are disposed in a vertical direction and are configured to be moved away from each other and brought toward each other,
the elastic member is disposed between the middle connecting base and the bottom connecting base to generate an elastic force to move the middle connecting base away from the bottom connecting base,
the first positioning mechanism is configured to limit a maximum distance between the middle connecting base and the bottom connecting base, and
the auxiliary opening mechanism comprises the middle connecting base, the bottom connecting base, the elastic member, the first positioning mechanism, the first support rod, and the second support rod.

16. The canopy frame with the auxiliary opening mechanism according to claim 15, wherein a length of the first support rod is longer than a length of the second support rod.

17. A canopy frame with an auxiliary opening mechanism, comprising:

a top connecting base,
a plurality of frame rod sets,
a middle connecting base,
a bottom connecting base,
an elastic member,
a first positioning mechanism, and
a sliding base, wherein:
each of the plurality of frame rod sets comprises:
a standing column,
a canopy rod set,
a first support rod,
a second support rod, and
a third support rod,
a top end of the standing column comprises a mounting base,
a first end of the canopy rod set comprises a first canopy rod that is rotatably connected to the top connecting base,
a second end of the canopy rod set is rotatably connected to the mounting base, two ends of the first support rod are respectively rotatably connected to the middle connecting base and the first canopy rod,
two ends of the second support rod are respectively rotatably connected to the bottom connecting base and the first support rod,
the sliding base is slidably connected to the standing column,
the canopy rod set comprises a second canopy rod,
an inner end of the second canopy rod is rotatably connected to an outer end of the first canopy rod,
an outer end of the second canopy rod is rotatably connected to the mounting base,
two ends of the third support rod are respectively rotatably connected to the second canopy rod and the sliding base,
a third positioning mechanism is disposed between the first canopy rod and the second canopy rod to limit a maximum arching angle of the first canopy rod and the second canopy rod,
the middle connecting base and the bottom connecting base are disposed in a vertical direction and are configured to be moved away from each other and brought toward each other,
the elastic member is disposed between the middle connecting base and the bottom connecting base to generate an elastic force to move the middle connecting base away from the bottom connecting base,
the first positioning mechanism is configured to limit a maximum distance between the middle connecting base and the bottom connecting base, and
the auxiliary opening mechanism comprises the middle connecting base, the bottom connecting base, the elastic member, the first positioning mechanism, the first support rod, and the second support rod.

18. The canopy frame with the auxiliary opening mechanism according to claim 17, wherein a length of the first support rod is longer than a length of the second support rod.

* * * * *